US008277176B2

(12) United States Patent
Pommier et al.

(10) Patent No.: US 8,277,176 B2
(45) Date of Patent: Oct. 2, 2012

(54) TURBOMACHINE EXHAUST CASE DRAIN

(75) Inventors: Nicolas Pommier, Brunoy (FR); Christian Rene Schnell, Forges (FR)

(73) Assignee: SNECMA, Paris (FR)

( * ) Notice: Subject to any disclaimer, the term of this patent is extended or adjusted under 35 U.S.C. 154(b) by 1188 days.

(21) Appl. No.: 12/048,505

(22) Filed: Mar. 14, 2008

(65) Prior Publication Data

US 2008/0226445 A1 Sep. 18, 2008

(30) Foreign Application Priority Data

Mar. 16, 2007 (FR) ..... 07 01905

(51) Int. Cl.
*F01D 11/00* (2006.01)
*F01D 25/32* (2006.01)
*F04D 29/00* (2006.01)
*F01B 31/18* (2006.01)

(52) U.S. Cl. ..... 415/168.1; 415/169.2; 415/169.4

(58) Field of Classification Search ..... 415/168.1, 415/168.2, 168.4, 169.1, 169.2, 169.4
See application file for complete search history.

(56) References Cited

U.S. PATENT DOCUMENTS

| | | | | |
|---|---|---|---|---|
| 4,538,834 | A * | 9/1985 | Brady et al. | 285/10 |
| 5,152,778 | A * | 10/1992 | Bales et al. | 606/205 |
| 7,370,477 | B2 * | 5/2008 | Roche et al. | 60/761 |
| 7,921,646 | B2 * | 4/2011 | Swenson et al. | 60/605.1 |
| 2011/0199220 | A1 * | 8/2011 | McAlister | 340/605 |

FOREIGN PATENT DOCUMENTS

| | | |
|---|---|---|
| EP | 1 304 514 A1 | 4/2003 |
| EP | 1 621 741 A1 | 2/2006 |
| FR | 2 643 678 | 8/1990 |

* cited by examiner

*Primary Examiner* — Edward Look
*Assistant Examiner* — Su Htay
(74) *Attorney, Agent, or Firm* — Oblon, Spivak, McClelland, Maier & Neustadt, L.L.P.

(57) ABSTRACT

A turbomachine exhaust case having an annular groove perforated with an orifice in which there is mounted a drain, which is formed by a tubular cylindrical body, for discharging liquids retained in this groove is disclosed. The drain includes a skirt, formed at one end of the cylindrical body, for fastening the drain by crimping in the orifice in the groove of the case.

10 Claims, 2 Drawing Sheets

TURBOMACHINE EXHAUST CASE DRAIN

The present invention relates to a liquid discharge drain in an exhaust case of a turbomachine such as a jet engine.

BACKGROUND OF THE INVENTION AND DESCRIPTION OF THE PRIOR ART

The exhaust case of a turbomachine generally comprises a groove which is formed downstream and in the vicinity of the upstream mounting flange of this case and which constitutes a dead region, that is to say one shielded from the primary air flow. It frequently occurs that liquids, such as water, fuel and oil, are retained in a region situated "at 6 o'clock", that is to say toward the bottom, in this groove.

Stagnation of these liquids is not desirable, particularly given the risks of fire and those associated with freezing, and for this reason the exhaust cases generally comprise an orifice provided with a drain in this dead region to discharge the liquids toward the outside of the turbomachine.

This drain is conventionally formed by a cylindrical body which is welded to the case at the aforementioned discharge orifice.

However, carrying out this welding is a long and difficult operation which cannot be readily controlled and which is relatively dangerous for the operator, this operation particularly requiring manual touch-ups to remove the excess material which projects into the drain and into the primary flow path in the region of the internal wall of the case. It is therefore necessary to allow for around four hours' work to carry out the complete operation of welding and removing excess material.

SUMMARY OF THE INVENTION

The object of the present invention is to provide a simple, effective and economic solution to this problem, particularly by simplifying the operation of mounting the drain on the exhaust case and by considerably reducing the work time required for this mounting operation.

Another object of the invention is to ensure a highly rigid and correctly sealed fastening of the drain to the case.

Accordingly, the invention provides a turbomachine exhaust case having an annular groove perforated with an orifice in which there is mounted a drain, formed by a tubular cylindrical body, for discharging liquids retained in this groove, wherein the drain comprises a skirt, formed at one end of the cylindrical body and crimped into the orifice in the groove of the case, for fastening the drain to the case.

Fastening the drain by crimping avoids having to employ an annular weld, the drawbacks of which have been specified above, and thus offers a significant time saving when mounting the drain on the exhaust case of the turbomachine, the total mounting time being approximately 30 minutes instead of several hours.

Advantageously, the drain is made of a metal alloy having a coefficient of thermal expansion which is higher than the coefficient of thermal expansion of the case around the mounting orifice for the drain.

The expansion of the drain, under the effect of the rise in temperature during operation, causes a jamming effect whereby the drain is jammed in the orifice in the case, thus making it possible to improve the fastening of the drain to the case.

According to a preferred embodiment of the invention, the mounting orifice for the drain comprises, at one end, a cylindrical portion connected by an internal rim to a frustoconical portion at the other end of the orifice, this frustoconical portion having an angle at the centre of approximately 60 degrees. The skirt of the drain, which has a smaller thickness than the cylindrical body and extends as a continuation of the internal surface of this cylindrical body, is applied to the internal rim and the frustoconical portion after crimping.

This configuration makes it possible to obtain optimum crimping and to minimize the risks of losing the drain during operation or during a maintenance phase on the turbomachine.

Advantageously, the cylindrical portion of the orifice has a diameter which is larger than the maximum diameter of the frustoconical portion.

The cylindrical portion thus forms a recess in which that end of the cylindrical body of the drain bearing the skirt is inserted, such that an annular rim of the cylindrical body, formed at the base of this skirt, is applied to a bottom of this recess.

According to one feature of the invention, the free end of the skirt after crimping is situated substantially level with the internal surface of the groove of the case.

It is possible to ensure good sealing between the drain and the exhaust case on which it is mounted, while at the same time maintaining the planarity of the internal wall of the groove of this case about its discharge orifice.

According to another feature of the invention, the drain is connected to the case by at least one weld point in order to reinforce its fastening to the case.

The invention also relates to a turbomachine, such as an aircraft jet engine, which comprises an exhaust case of the type described above.

The invention additionally relates to an exhaust case drain in a turbomachine, which comprises a tubular cylindrical body continued at one end by a cylindrical crimping skirt having a smaller thickness than the body and continuing the internal surface of the cylindrical body.

BRIEF DESCRIPTION OF THE DRAWINGS

Other advantages and features of the invention will become apparent on reading the description given below by way of nonlimiting example and with reference to the appended drawings, in which.

DESCRIPTION OF THE PREFERRED EMBODIMENTS

Figure 1:
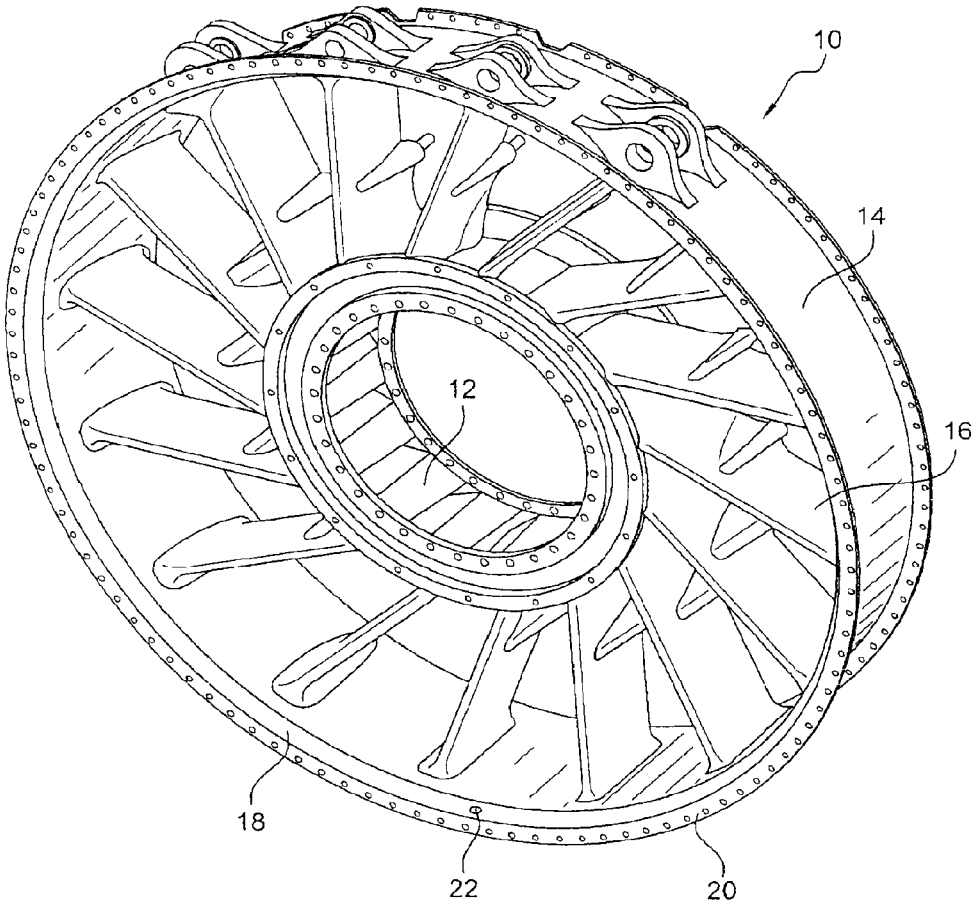
Fig. 1 BACKGROUND ART
FIG. 1 is a schematic perspective view of a turbomachine exhaust case according to the prior art.

Reference will be made first of all to FIG. 1, which shows a turbomachine exhaust case 10 of a known type, as seen from the upstream end, comprising two coaxial cylindrical shells, one inner shell 12 and one outer shell 14, connected by oblique arms 16. The outer shell 14 includes at its upstream end an annular groove 18 which is situated downstream and in the vicinity of the upstream mounting flange 20 of the exhaust case, a region of which groove situated "at 6 o'clock", that is to say at the bottom, is perforated with a discharge orifice 22 provided with a drain intended to outwardly discharge liquids liable to be collected in this groove.

Figure 2:
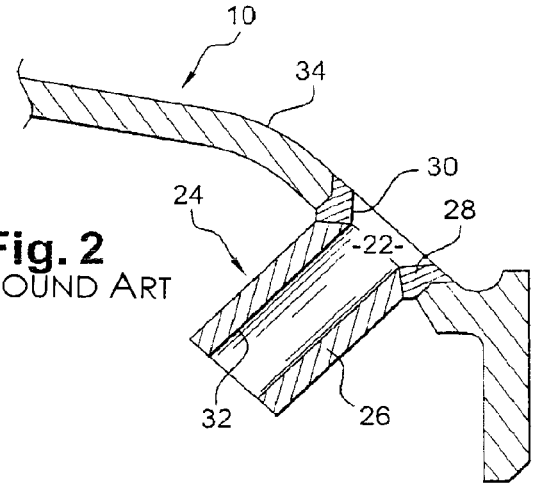
Fig. 2 BACKGROUND ART
FIG. 2 is a schematic view in axial section of part of the exhaust case shown in FIG. 1.

FIG. 2 is a larger-scale view of the discharge orifice 22 and its drain 24, which is formed by a tubular cylindrical body 26 fastened to the rim of the orifice 22 by an annular weld 28 formed around the periphery of this orifice. The surface 30 of the weld 28 that connects the internal wall 32 of the drain to the internal wall 34 of the groove 18 of the case is frustoconical.

The operation of mounting the drain 24 on the exhaust case 10 consists in particular in producing the weld 28 and then manually touching up this weld in order to remove any excess material on the internal wall 32 of the drain and on the internal wall 34 of the groove 18, and to form the frustoconical surface of the weld 28. Such a mounting operation requires approximately four hours' work.

During operation, it is frequently the case that small quantities of water are trapped in the groove 18 of the outer shell 14 of the exhaust case 10. It may occur that a small amount of fuel is also present in this region, particularly in the event of an aborted startup of the turbomachine, or else oil should there be a leak in the corresponding circuit. The drain 24 makes it possible to discharge these liquids toward the outside and in so doing thus avoid the risks associated with the freezing of these liquids and with fire.

The present invention aims to modify the way in which the drain is fastened to the exhaust case in order to avoid having to employ an annular weld as in the prior art.

Figure 3:
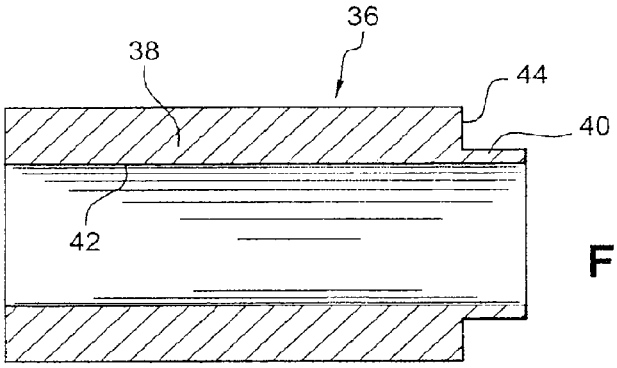
FIGS. 3 and 4 are partial schematic views in axial section of a turbomachine exhaust case according to the invention.

FIG. 3 schematically represents a drain 36 according to the invention prior to mounting it on the exhaust case 10. This drain comprises a tubular cylindrical body 38 and a skirt 40, which is formed at one end of the body 38, which has a smaller thickness than this body, and which extends as a continuation of the internal surface 42 of the body, this skirt 40 being intended to allow the drain 36 to be fastened by crimping in the orifice 22 in the groove 18 of the case. That end of the cylindrical body 30 bearing the skirt 40 forms an annular rim 44 at the base of this skirt.

Figure 4:
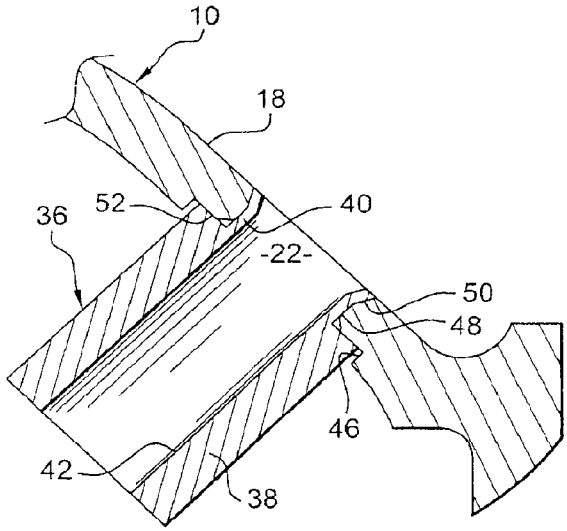

FIG. 4 represents the drain 36 mounted in the orifice 22 in the exhaust case 10 after crimping its skirt 40. This orifice has been machined to allow this crimping for the purpose of fastening the drain to the case, and comprises, at one end outside the groove, a cylindrical portion 46 which is connected by an internal rim 48 to a frustoconical portion 50 at the other end of the orifice inside the groove, this frustoconical portion 50 having an angle at the centre of approximately 60 degrees.

The cylindrical portion 46, the internal diameter of which is substantially equal to the external diameter of the cylindrical body 38 of the drain 36, forms a recess having a bottom 52 which is bounded by the internal rim 48 of the orifice and to which the annular rim 44 of the drain 36 is applied.

The skirt 40 has an external diameter substantially equal to the internal diameter of the rim 48 and is applied to the frustoconical portion 50 of the orifice 22 so as to ensure that the drain is retained on the case.

The drain 36 is made of a metal alloy with a coefficient of thermal expansion which is higher than that of the exhaust case 10. Thus, the rise in temperature inherent to the operation of the turbomachine causes the skirt 40 to be pressed and jammed against the cylindrical portion 48 and frustoconical portion 50 of the orifice 22, the effect of which is to reinforce the fastening of the drain 36 to the case 10.

The free end of the skirt 40 is situated substantially level with the surface of the groove 18 of the case in order to optimize the crimping while at the same time avoiding a situation in which this free end of the skirt projects into the groove.

Crimping the skirt 40 is a quick and simple operation, which can be carried out for example using a crimping gun, and requires approximately 30 minutes.

It may nevertheless be advantageous, to further reinforce the fastening of the drain 36 to the exhaust case 10, to provide one or more weld points connecting the drain to the case.

Furthermore, should the need arise, for example if the drain 36 has become damaged, it is possible to replace this drain with a welded drain of known type, after the orifice 22 in the groove 18 of the exhaust case has been reperforated to provide a smooth orifice compatible with this type of drain.

The invention claimed is:

1. A turbomachine exhaust case comprising:

an annular groove perforated with an orifice; and a drain mounted in the orifice, formed by a tubular cylindrical body, for discharging liquids retained in the groove, wherein the drain comprises a skirt, formed at a first end of the cylindrical body and crimped into the orifice in the groove of the case, for fastening the drain to the case, wherein the orifice comprises, at a first end, a cylindrical portion connected by an internal rim to a frustoconical portion at a second end of the orifice, the skirt of the drain being applied to the internal rim and the frustoconical portion after crimping, and wherein the drain presents an annular rim at a first end of the skirt, the annular rim of the drain abuts a recess between the cylindrical portion and the internal rim of the orifice, and an external surface of the skirt abuts an internal surface of the internal rim and the frustoconical portion of the orifice after crimping.

2. The turbomachine case as claimed in claim 1, wherein the drain is made of a metal alloy having a coefficient of thermal expansion which is higher than a coefficient of thermal expansion of the case around the orifice.

3. The turbomachine case as claimed in claim 1, wherein an internal diameter of the cylindrical portion of the orifice is substantially equal to the external diameter of the cylindrical body.

4. The turbomachine case as claimed in claim 1, wherein the skirt has a smaller thickness than the cylindrical body and extends as a continuation of an internal surface of the cylindrical body.

5. The turbomachine case as claimed in claim 1, wherein a free end of the skirt after crimping is situated substantially level with an internal surface of the groove of the case.

6. The turbomachine case as claimed in claim 1, wherein the frustoconical portion of the orifice has an angle at its center of approximately 60 degrees.

7. The turbomachine case as claimed in claim 1, wherein the drain is connected to the case by at least one weld point in order to reinforce its fastening to the case.

8. A turbomachine, including a turbomachine exhaust case comprising:

an annular groove perforated with an orifice; and a drain mounted in the orifice, formed by a tubular cylindrical body, for discharging liquids retained in the groove, wherein the drain comprises a skirt, formed at a first end of the cylindrical body and crimped into the orifice in the groove of the case, for fastening the drain to the case, wherein the orifice comprises, at a first end, a cylindrical portion connected by an internal rim to a frustoconical portion at a second end of the orifice, the skirt of the drain being applied to the internal rim and the frustoconical portion after crimping, and wherein the drain presents an annular rim at a first end of the skirt, the annular rim of the drain abuts a recess between the cylindrical portion and the internal rim of the orifice, and an external surface of the skirt abuts an internal surface of the internal rim and the frustoconical portion of the orifice after crimping.

9. An exhaust case drain in a turbomachine, comprising:

a tubular cylindrical body continued at one end by a cylindrical crimping skirt having a smaller thickness than the body, the skirt being mounted in an orifice, wherein the orifice comprises, at a first end, a cylindrical portion connected by an internal rim to a frustoconical portion at a second end of the orifice, the skirt being applied to the internal rim and the frustoconical portion after crimping, and wherein the drain presents an annular rim at a first end of the skirt, the annular rim of the drain abuts a recess between the cylindrical portion and the internal rim of the orifice, and an external surface of the skirt abuts an internal surface of the internal rim and the frustoconical portion of the orifice after crimping.

10. The drain as claimed in claim 9, wherein the skirt continues along an internal surface of the cylindrical body.

* * * * *